US005948282A

United States Patent [19]

Hu

[11] Patent Number: 5,948,282

[45] Date of Patent: Sep. 7, 1999

[54] PROCESS FOR TRANSFER PRINTING PAPERS HAVING FLIP-FLOP EFFECTS

[76] Inventor: Sheng-Chih Hu, No. 7, Lane 170, San Feng Rd., Feng Yuan City, Taichung Hsien, Taiwan

[21] Appl. No.: 08/937,133

[22] Filed: Sep. 24, 1997

[51] Int. Cl.[6] ..... B44C 1/22

[52] U.S. Cl. ..... 216/36; 216/54; 216/100

[58] Field of Search ..... 216/33, 36, 40, 216/54, 100

[56] References Cited

U.S. PATENT DOCUMENTS

| | | | |
|---|---|---|---|
| 3,006,795 | 10/1961 | Brickell | 216/36 |
| 3,287,192 | 11/1966 | Pohlenz | 216/36 |
| 5,186,787 | 2/1993 | Phillip et al. | 216/36 |

FOREIGN PATENT DOCUMENTS

| | | | |
|---|---|---|---|
| 5-16597 | 1/1993 | Japan | 216/36 |
| 2175849 | 12/1986 | United Kingdom | 216/36 |

*Primary Examiner*—William Powell
*Attorney, Agent, or Firm*—Bacon & Thomas

[57] ABSTRACT

A process for transfer printing papers having a flip-flop effect is disclosed. A substrate consisting of a base paper, a glue, a transparent tape, a transparent resin, a hydrophilic paint and a metal layer is manufactured by a vapor deposition method. A flip-flop ink having a predetermined pattern is printed on the substrate. The metal layer which is not covered by the ink is etched by an alkaline solution. The alkaline solution is neutralized by an acid solution. The substrate is washed and then dried so that the transfer printing papers having a flip-flop effect are obtained.

7 Claims, 1 Drawing Sheet

PROCESS FOR TRANSFER PRINTING PAPERS HAVING FLIP-FLOP EFFECTS

BACKGROUND OF THE INVENTION

The present invention relates to a process for transfer printing papers. More particularly, the present invention relates to transfer printing papers having flip-flop effects.

Conventional process for transfer printing papers involves printing ink having a determined shape on a metal layer which is provided on a substrate, resulting in an aesthetic effect due to the combination of the ink and reflecting effect of the metal layer. However, the conventional transfer printing papers still need to be modified due to the following reasons:

1. Most of the conventional transfer printing papers are monochromatic. Multichromatic effect can be achieved by printing a plurality of colors, however, the printing process will be uneconomic and time-consuming.
2. Color migration might occur during the colors printing, thus reducing the yield of process for transfer printing papers.
3. The aesthetic effects might be diminished since the colors will be blurred due to overlapping.

In view of the drawbacks occurring in the prior art methods, the present invention solves the problems heretofore commonly in existence.

It is the purpose of this present invention, therefore, to mitigate and/or obviate the above-mentioned drawback in the manner set forth in the detailed description of the preferred embodiment.

SUMMARY OF THE INVENTION

It is an object of this invention to provide a process for transfer printing papers having a flip-flop effect in an economic and time-saving manner.

Further objects and advantages of the present invention will become apparent as the following description proceeds, and the features of novelty which characterize the invention will be pointed out with particularity in the claims annexed to and forming a part of this application.

DETAILED DESCRIPTION OF THE PREFERRED EMBODIMENTS

Figure 1:
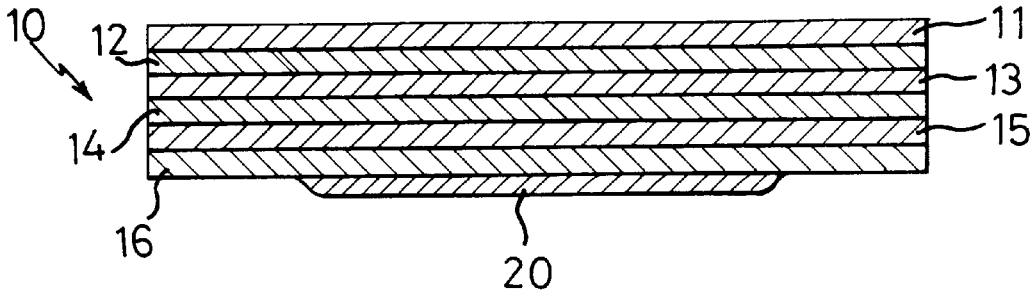
FIG. 1 is a cross-sectional view of a transfer printing paper of the present invention prior to etching is performed.

In reference to FIG. 1, a process for transfer printing papers 10 having a flip-flop effect is performed at 22° C. to 25° C. a humidity of 75% to 85%.

The first step is the manufacture of a substrate consisting of a base paper 11, a glue 12, a transparent tape 13, a transparent resin 14, a hydrophilic paint 15 and a metal layer 16 in sequence by a vapor deposition method.

The second step is to print a flip-flop ink 20 of determined patterns on the substrate by means of a screen printing. The flip-flop ink 20 is prepared from applying a metal powder such as Al and Ni to a solvent, mixing the solution by a mixer at 1000 to 1500 rpm for 5 to 10 minutes, adding a defoaming agent and a leveling agent and further mixing 2 to 3 minutes, adding acrylic resin and butylated melamine resin, and then adding calcium carbonate and an anti-settling agent. The surface of the flip-flop ink 20 which is illuminated by a light source, may, depending on the visual angle, have different colors. The flip-flop effect is achieved by using only one ink 20, i.e., it is not necessary to perform a plurality of printing steps for obtaining the flip-flop effect as used in prior art methods.

Figure 2:
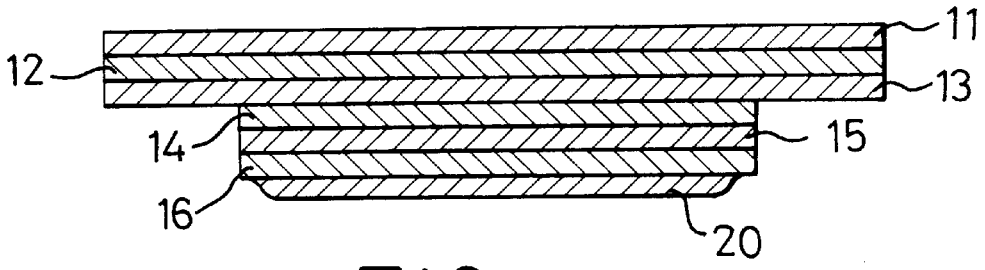
FIG. 2 is a cross-sectional view of a transfer printing paper of the present invention after the etching is performed.

The third step, in reference to FIG. 2, is to dry the substrate thus obtained in the previous step and then immerse the substrate into a weak alkaline solution, for example, a sodium carbonate solution having a ratio of sodium carbonate to water of 1:5 and a temperature of 30° C. to 35° C., for 10 to 15 seconds so that the metal layer 16 which is not covered by the ink 20 and the corresponding portions of the hydrophilic paint 15 and the transparent resin 14 are etched simultaneously.

The fourth step is to immerse the substrate thus obtained in the previous step into a weak acid solution, for example a glacial acetic acid solution having a ratio of glacial aceteic acid:water of 1:5 and a temperature of 30° C. to 40° C., for about 5 seconds to neutralize the alkaline solution remaining on the substrate.

The fifth step is to wash the substrate thus obtained so as to completely remove the remaining acid solution, alkaline solution, powders of metal layer 16, hydrophilic paint 15, and transparent resin 14.

The sixth step is to air dry the substrate thus obtained in the previous step or perform the drying at 30° C. to 40° C.

After the dried substrate is effected a surface finishing treatment, a transfer printing paper 10 having a combination of the flip-flop effect of ink 20 and the reflecting effect of the metal layer 16 is obtained.

Figure 3:
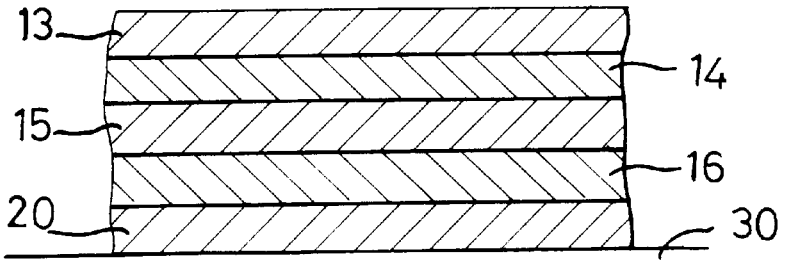
FIG. 3 is a cross-sectional view of an embodiment of the present invention, in which the transfer printing paper is applied to an object.

After the transfer printing paper 10 is subjected to a static treatment, the ink 20 is directly applied to an object 30 and then the base paper 11 and glue 12 are removed, in reference to FIG. 3, so that the combination of the flip-flop effect of the ink 20 and the reflective effect of the metal layer 16 imparts the object 30 with a multichromatic effect when visual angles vary. Thus, the third party will find it difficult to imitate and copy the special effects of the present invention.

Accordingly, the present invention provides a process for transfer printing papers having a flip-flop effect, in which the substrate having a metal layer 16 thereon is formed with a flip-flop ink 20 and the metal layer 16 is etched by an alkaline solution, resulting in the transfer printing paper 10 having a flip-flop effect. The transfer printing paper 10 of the present invention overcome the shortcomings of the conventional transfer printing paper and also can be produced in an economic and time-saving manner.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A process for transfer printing papers having a flip-flop effect, which is performed at room temperature and a specific humidity, comprising the steps of providing a substrate consisting of a base paper, a glue, a transparent tape, a transparent resin, a hydrophilic paint and a metal layer in sequence;

printing a flip-flop ink having determined patterns on said substrate by means of screen printing;

etching said metal layer which is not covered by said ink by an alkaline solution so that corresponding portions of said hydrophilic paint and said transparent resin are etched;

neutralizing said alkaline solution with an acid solution; and washing and then drying said substrate.

2. A process according to claim 1, in which said ink is prepared from applying a metal powder to a solvent, mixing said solution at 1000 to 15000 rpm for 5 to 10 minutes, adding a defoaming agent and leveling agent and further mixing 2 to 3 minutes, adding acrylic resin and butylated melamine resin, and then adding calcium carbonate and an anti-settling agent.

3. A process according to claim 1, in which said alkaline solution is sodium carbonate having a ratio of sodium carbonate:water of 1:5, having a temperature of 30° C. to 35° C.

4. A process according to claim 1 or 3, in which said substrate is immersed into said alkaline solution for 10 to 15 seconds.

5. A process according to claim 1, in which said acid solution is glacial acetic acid having a ratio of glacial acetic acid:water is 1:5, having a temperature of 30° C. to 40° C.

6. A process according to claim 1 or 5, in which said substrate is immersed into said acid solution for about 5 seconds.

7. A process according to claim 1, in which said room temperature is in a range of 22° C. to 25° C. and humidity is 75% to 85%.

* * * * *